US008485216B2

(12) United States Patent
Higgins

(10) Patent No.: US 8,485,216 B2
(45) **Date of Patent: *Jul. 16, 2013**

(54) FLOW TRAP WITH COMPARTMENT SEPARATOR AND BAFFLE FOR USE IN A WATER-FREE URINAL

(75) Inventor: Michael Higgins, La Habra Heights, CA (US)

(73) Assignee: Falcon Waterfree Technologies, LLC, Los Angeles, CA (US)

( * ) Notice: Subject to any disclaimer, the term of this patent is extended or adjusted under 35 U.S.C. 154(b) by 598 days.

This patent is subject to a terminal disclaimer.

(21) Appl. No.: 12/462,847

(22) Filed: Aug. 10, 2009

(65) Prior Publication Data

US 2010/0024892 A1 Feb. 4, 2010

Related U.S. Application Data

(60) Division of application No. 11/032,310, filed on Jan. 9, 2005, now Pat. No. 7,571,741, and a continuation-in-part of application No. 10/647,603, filed on Aug. 25, 2003, now Pat. No. 6,973,939, and a continuation-in-part of application No. 10/744,708, filed on Dec. 23, 2003, now abandoned.

(60) Provisional application No. 60/535,463, filed on Jan. 9, 2004, provisional application No. 60/579,921, filed on Jun. 14, 2004.

(51) Int. Cl.
*E03C 1/28* (2006.01)
*E03C 1/29* (2006.01)
*A47K 11/12* (2006.01)

(52) U.S. Cl.
USPC ..... 137/247.29; 137/247.11; 4/144.1; 4/301; 4/309; 4/679

(58) Field of Classification Search
USPC ..... 137/247.11, 247.27, 247.29, 247.33, 137/247.35, 247.31; 4/144.1, 309, 310, 311, 4/679
See application file for complete search history.

(56) References Cited

U.S. PATENT DOCUMENTS 208,139 A * 9/1878 Austin ..... 137/247.29
341,310 A * 5/1886 Barrett ..... 4/251.1
465,820 A * 12/1891 King ..... 137/247.29

(Continued)

FOREIGN PATENT DOCUMENTS

EP 0365789 * 5/1990

*Primary Examiner* — John Rivell

(57) ABSTRACT

In a urine cartridge or wastewater trap, equalized pressures and increased flow rate between its inlet and outlet compartments increases the life of the cartridge. The pressure equalizing is effected by placement of a separator between the two compartments to provide them with substantially equal volumes. The increased flow rate is created by a uniquely configured baffle positioned adjacent a pan at the bottom of the cartridge. The baffle configuration is shaped to provide a constriction that increases the flow velocity of the urine so that the fluid flow effects a channel along the bottom pan and through any solids deposited on the bottom pan. A diverter may be placed above the centrally located entry to the inlet compartment to create a circuitous path for preventing a disturbing impingement of the urine onto the sealant contained in the inlet compartment. To accommodate the centrally placed entry and its placement vis-a-vis the inlet compartment, the separator is bowed at its location adjacent the entry and towards the outlet compartment. To fit the configuration of the baffle, the separator is curved generally in a likewise manner.

28 Claims, 12 Drawing Sheets

U.S. PATENT DOCUMENTS 478,808 A * 7/1892 Newton ..... 137/247.11
539,775 A * 5/1895 Lennihan ..... 137/247.11
649,340 A * 5/1900 Nelson ..... 137/247.11
668,776 A * 2/1901 Riley ..... 137/247.29
5,711,037 A * 1/1998 Reichardt et al. ..... 4/144.1
6,053,197 A * 4/2000 Gorges ..... 137/247.39
6,286,153 B1 * 9/2001 Keller ..... 4/144.1
6,418,569 B1 * 7/2002 Knight ..... 4/679
6,701,541 B2 * 3/2004 Romagna et al. ..... 137/247.35
7,571,741 B2 * 8/2009 Higgins ..... 137/247.29

* cited by examiner

FLOW TRAP WITH COMPARTMENT SEPARATOR AND BAFFLE FOR USE IN A WATER-FREE URINAL

CROSS-REFERENCE TO RELATED APPLICATION

This is a division of application Ser. No. 11/032,310 filed 9 Jan. 2005 (U.S. Pat. No. 7,571,741 issued 11 Aug. 2009). This application further claims the benefit of U.S. Provisional Application No. 60/535,463, filed 9 Jan. 2004, and U.S. Provisional Application No. 60/579,921, filed 14 Jun. 2004, and is a continuation-in-part of the following provisional and nonprovisional applications: Ser. No. 10/647,603, filed 25 Aug. 2003 now U.S. Pat. No. 6,973,939; Ser. No. 10/744,708, filed 23 Dec. 2003 now abandoned; Application No. 60/535,463, filed 9 Jan. 2004; and any of their predecessor applications.

REFERENCE REGARDING FEDERAL SPONSORSHIP

Not Applicable

REFERENCE TO MICROFICHE APPENDIX

Not Applicable

1. Field of the Invention

The present invention relates to a flow trap, such as a cartridge used in water-free urinals having an odor preventing closure mechanism and, in particular, to improvements in the internal liquid flow path and sealant integrity of such a cartridge and, additionally, to improving flow trap life and usability, including a reduction in the need for the servicing and replacement of such cartridges.

2. Description of Related Art and Other Considerations

In existing water-free urinals, the life and usability of cartridges employed in water-free urinals has been found to be dependent, in part, upon the need for their servicing and replacement when debris and matter are deposited therein. For example, in the cartridges described in U.S. Pat. Nos. 6,053,197, 6,644,339 and 6,425,411 and U.S. patent application, Ser. No. 10/143,103 (filed 7 May 2002), as the liquids flow from the inlet compartment to the outlet compartment and thence to an external drain, the flow is sufficiently gentle that solid matter contained in the fluid deposits in the pan of the bottom portion and eventually builds up to block flow from the inner compartment to the outlet compartment. As a consequence, the cartridge needs to be replaced. Further, it has been observed that unequal pressures between the two compartments create syphoning therebetween and, particularly, of syphoning of sealant from the inlet compartment to the outlet compartment, which leads to premature failure and a reduction in the usable life of the cartridge.

SUMMARY OF THE INVENTION

These and other problems are successfully addressed and overcome by the present invention, along with attendant advantages, by equalizing the pressures and by increasing the flow rate between the inlet and outlet compartments. Such pressure equalizing is effected preferably by establishing substantially equal volumes in the two compartments and, specifically, by use of a separator. Such increased flow rate is effected by use of a baffle positioned at the bottom of the cartridge adjacent the pan, which baffle is so configured as to provide a constriction that increases the flow velocity of the urine and thus to use the fluid flow to effect a flow path or channel of least resistance through any solid matter in the bottom pan and thus to remove or carry away or displace solids that may be or have been in the wastewater or urine and thus not deleteriously affect or otherwise substantially deter flow into the outlet compartment. Such action may also otherwise avoid the build up of deposits on the bottom portion. In addition, it is preferred to locate the entry to the inlet compartment centrally of the cartridge so that a diverter may be placed above the entry and thereby to create a circuitous path for preventing turbulence or a disturbing impingement of the urine onto the sealant contained in the inlet compartment. To accommodate the centrally placed entry and its placement vis-a-vis the inlet compartment, the separator is bowed at its location adjacent the entry and towards the outlet compartment. To fit the configuration of the baffle, the separator is curved generally in a likewise manner.

Several advantages are obtained derived from these arrangements. The life and usability of the cartridge is extended. Sealant is conserved. Deposits of solid matter within the cartridge are at least minimized. Of importance, the fluid flow effects a flow path or channel of least resistance through any solid matter in the bottom pan.

Other aims and advantages, as well as a more complete understanding of the present invention, will appear from the following explanation of an exemplary embodiment and the accompanying drawings thereof.

DETAILED DESCRIPTION

Figure 7:
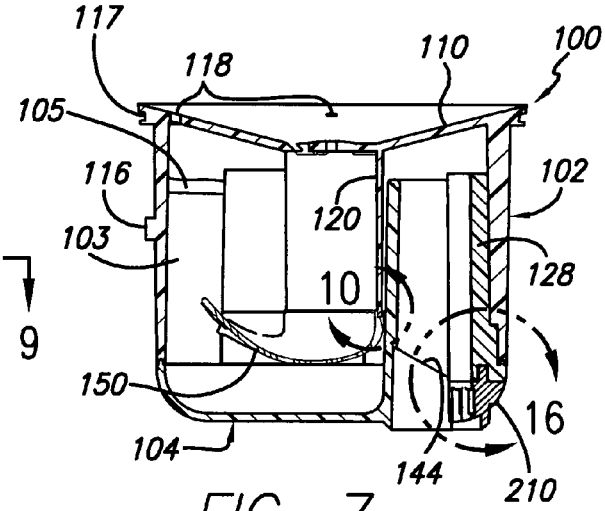
FIG. 7 is a cross-sectional view of the cartridge taken along line 7-7 of FIG. 3.

Accordingly, referring to FIGS. 1-27, a cartridge assembly 100, acting as a flow trap for urine or other generally fluid waste products, comprises a top portion 102 (FIGS. 19-27) and a bottom portion 104 (FIGS. 11-15). A fluid 103 with urine therein and an oily sealant 105 atop the fluid is contained within the cartridge, as illustrated in FIGS. 7 and 9.

Figure 5:
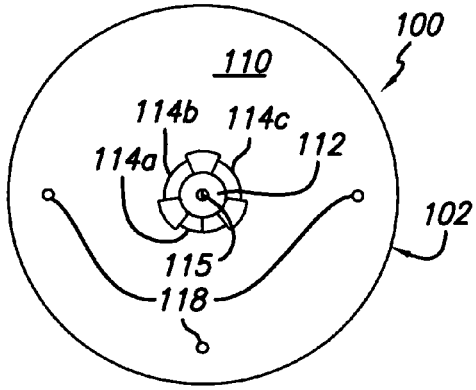
Figure 6:
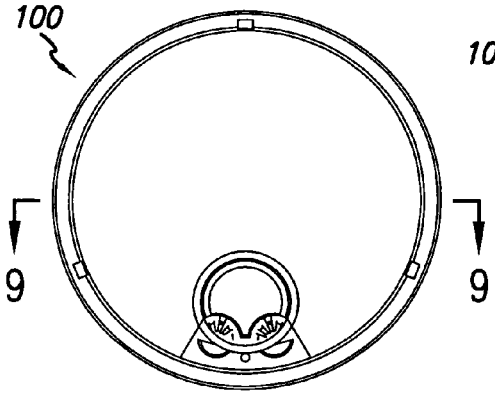

Top portion 102 has a cylindrical configuration defined by a tubular wall 106 terminated by an opening 108 at its lower end and a top wall 110 at its upper end. The top wall is sloped downwardly to a flat, generally horizontal flat center portion 112 in which an entry opening 114 is disposed, to act as a urine inlet. As depicted in FIG. 5, opening 114 comprises a tripartite arrangement of three arced slots 114*a*, 114*b* and 114*c*. A hole 115 is centrally positioned within center portion 112. As will be described with respect to FIGS. 36-43, slots 114*a*, 114*b* and 114*c* and hole 115 are adapted to hold either of the two diverters to cartridge 100. Top portion 102 is further provided with three keys 116 of which one may be of different length than the other two (e.g., see FIG. 2) for purposes of properly placing and orienting cartridge 100 within a urinal, as more fully described in U.S. Pat. No. 6,644,339 (the parent application of above-noted Ser. No. 10/647,603).

Figure 44:
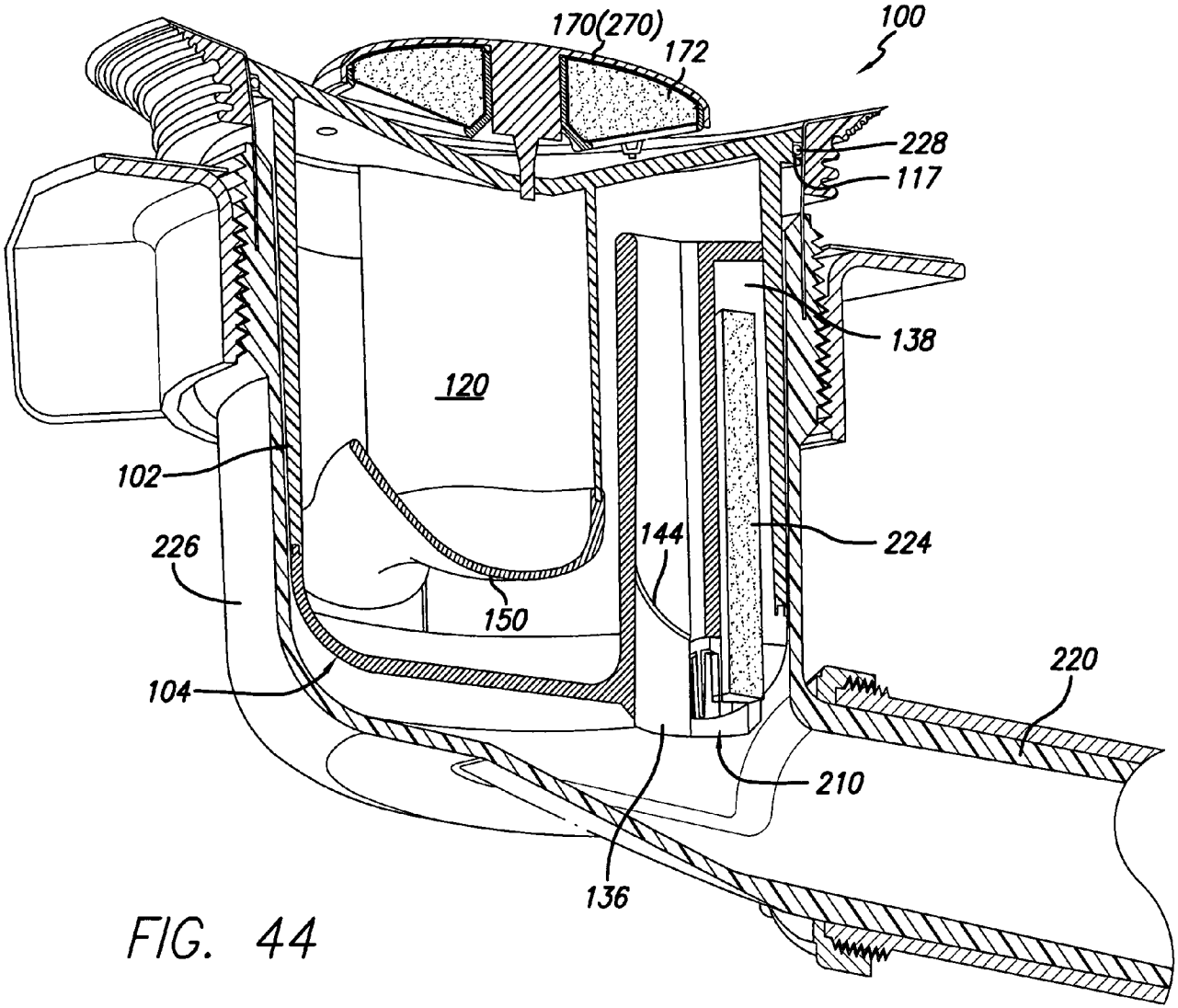
FIG. 44 is a perspective of the cartridge, such as depicted in FIG. 36, placed in a urinal housing for coupling of the cartridge to a drain pipe.

Top wall 110 is provided with a recess 117 as shown in FIGS. 7, 9, 24, 26 and 44 at its outer periphery to accept a seal, such as O-ring seal 228 (see FIG. 44). Recess 117 has a small dimension sufficient to minimize the trapping of urine therein.

Top wall 110 of top portion 102 is further provided with three openings 118 which act as air vents that communicate with the interior of cartridge 100. In the event that one of the openings becomes clogged, such as by urine when the urinal is in use, there will be at least one that remains open. Openings 118 also provide a means by which a tool may be inserted therein for the purpose of inserting and removing the cartridge into and from a urinal, as also described in above-noted co-pending provisional application No. 60/535,463, now patent application Ser. 11/032,508. Accordingly, for purposes of their use as tool engagement means, it is preferred that the outermost two openings be approximately diagonally opposed to one another. However, the placement or use of these openings may be otherwise designed to accommodate other tool configurations.

Figure 8:
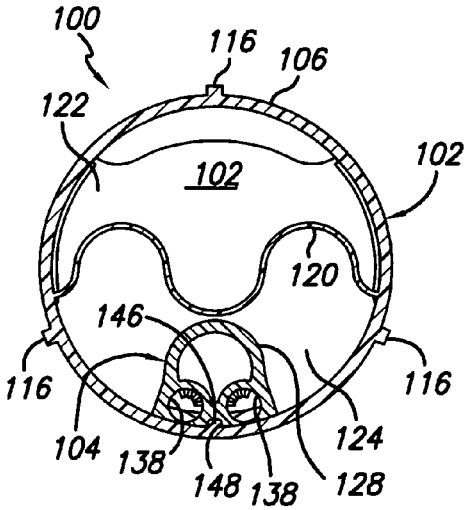
FIG. 8 is a cross-sectional view of the cartridge taken along line 8-8 of FIG. 4.
Figure 9:
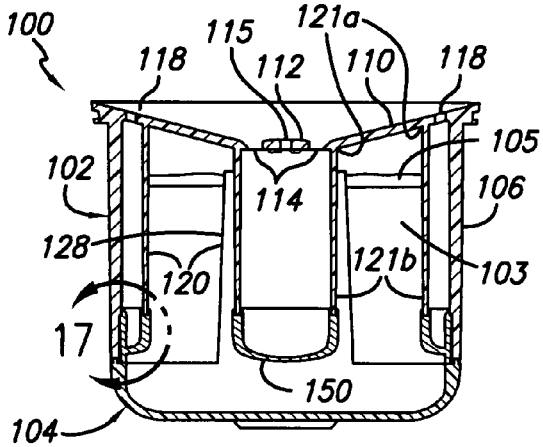
FIG. 9 is a cross-sectional view of the cartridge taken along line 9-9 of FIG. 6.

The interior of top portion 102 is divided by a bowed vertical separator 120 (e.g., see FIGS. 2, 8 and 18) into two compartments, respectively an inlet compartment 122 and an outlet compartment 124 (e.g., FIG. 8). Vertical separator 120 is secured or molded to the interior surface of tubular wall 106 and to the underside of top wall 110 at a terminus 121*a* (e.g., see FIG. 9) in any convenient manner. The bottom end of the vertical separator terminates in an end or terminus 121*b* (e.g., FIG. 2) which is disposed to be connected to a baffle 150 which, in turn, will be presently described fully in FIGS. 28-35. When top and bottom portions 102 and 104 are placed together and a discharge section 128 (FIGS. 7, 8 and 11-14) of bottom portion 104 extends into outlet compartment 124, inlet compartment 122 and outlet compartment 124 have generally equal volumes. It is important that the compartment volumes be made as equal as possible to ensure that the pressures on both sides of vertical separator 120 remain equal during use of the cartridge. Such pressure equality helps to minimize syphoning or, alternatively, to maximize resistance to syphoning between the compartments and, of particular importance, of sealant 105 from the inlet compartment to the outlet compartment. Thus, the usable life of the cartridge is improved by avoiding premature failure thereof. Additionally, any impediment to liquid flow in minimized.

Figure 23:
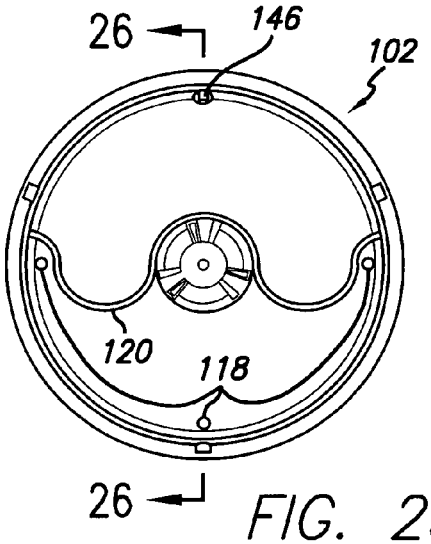
Figure 24:
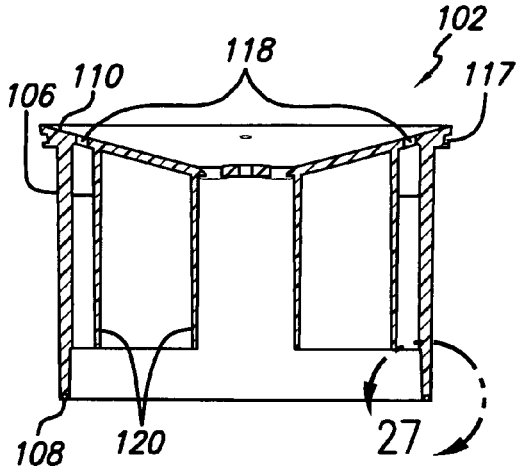
FIG. 24 is a cross-sectional view of the cartridge top portion taken along line 24-24 of FIG. 21.
Figure 25:
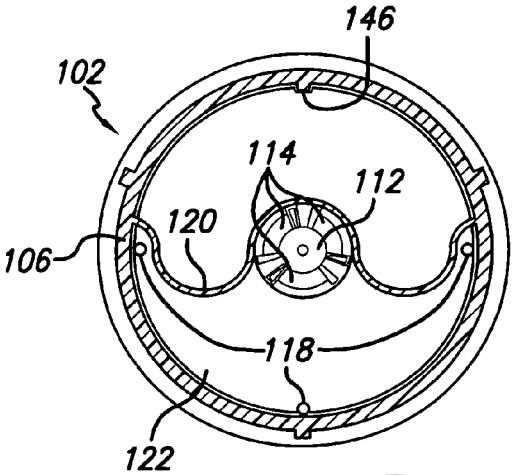
FIG. 25 is a cross-sectional view of the cartridge top portion taken along line 25-25 of FIG. 22.
Figure 26:
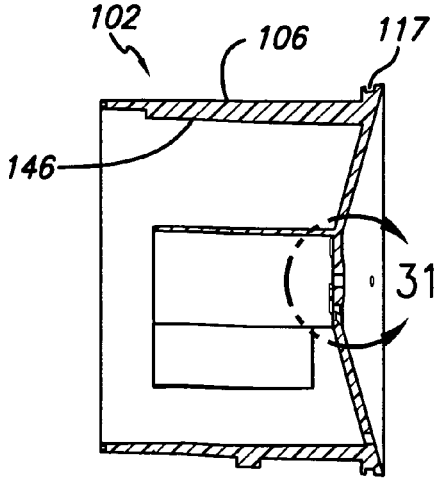
FIG. 26 is a cross-sectional view of the cartridge top portion taken along line 26-26 of FIG. 23.
Figure 27:
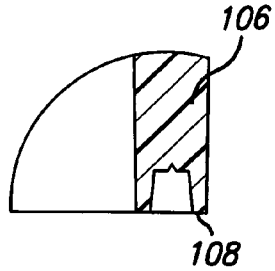
FIG. 27 is a cross-sectional enlarged view of the cartridge top portion taken along cutaway line 27 of FIG. 24.
Figure 28:
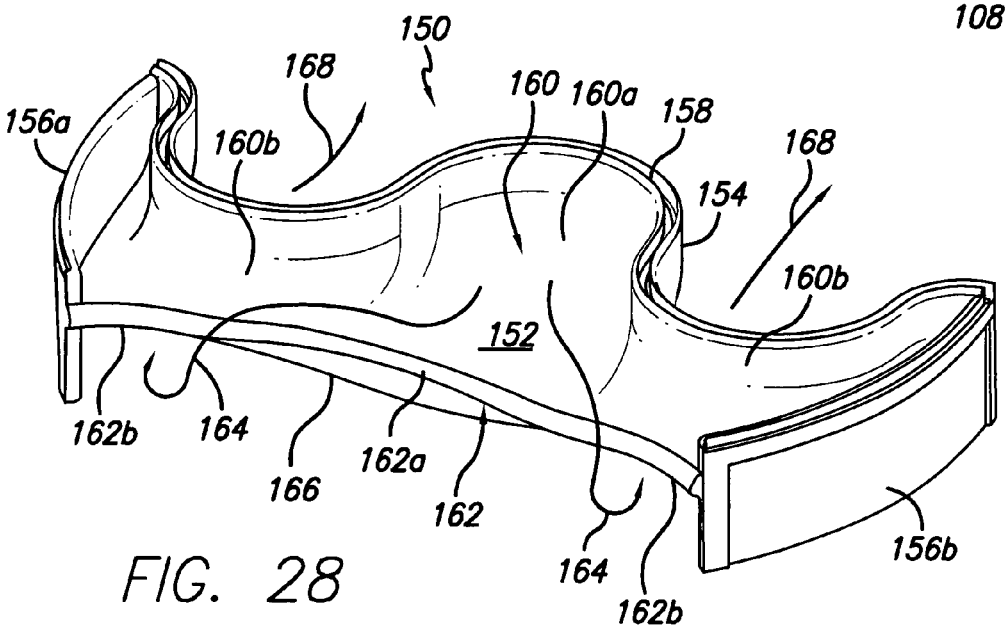
FIG. 28 is a perspective view of the baffle, in the interior of the cartridge, viewed towards its top surface.
Figure 29:
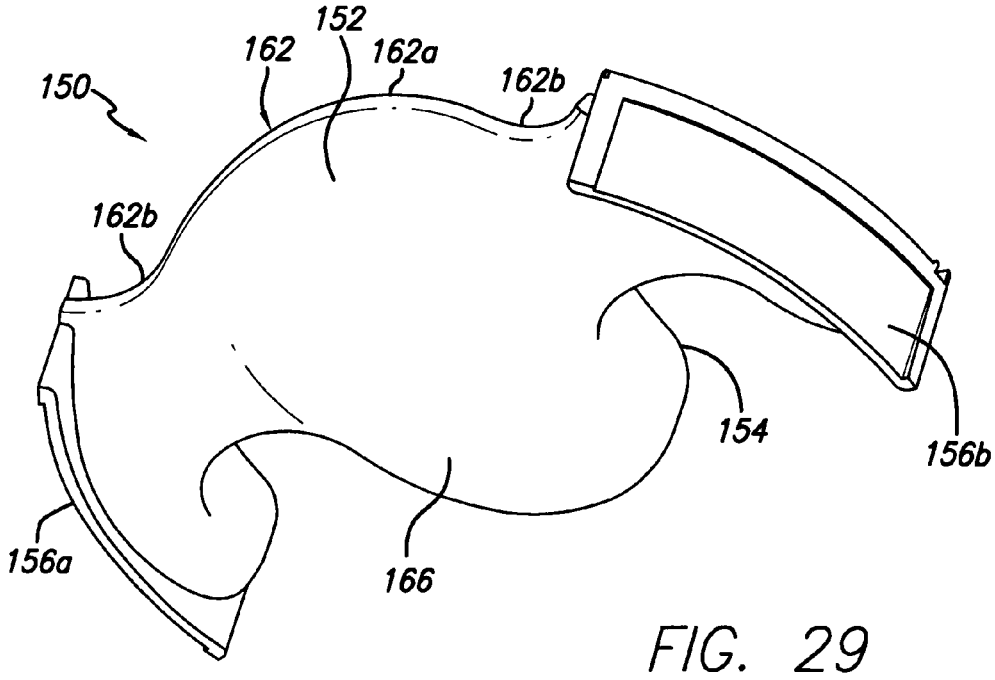
FIG. 29 is a perspective view of the baffle viewed towards its lower surface.
Figure 34:
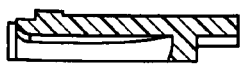
FIG. 34 is a cross-sectional view of the baffle taken along line 34-34 of FIG. 30.
Figure 35:
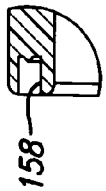
FIG. 35 is a cross-sectional enlarged view of the baffle taken along cutaway line 35 of FIG. 33.
Figure 33:
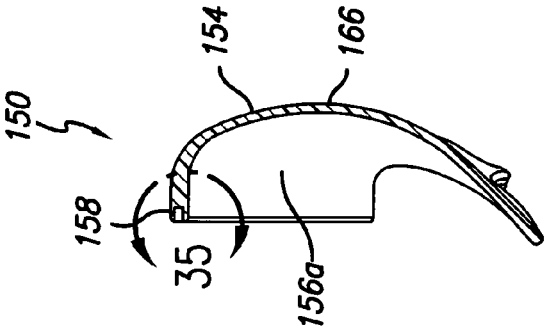
FIG. 33 is a cross-sectional view of the baffle taken along line 33-33 of FIG. 30.
Figure 32:
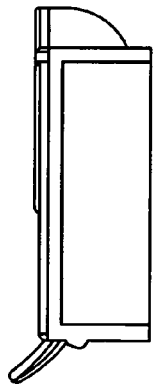
FIGS. 30-32 respectively are a top view and two side views, taken orthogonally with respect to one another, of the baffle.

Vertical separator 120 is bowed, e.g., curved or bent, to accommodate centrally positioned entry opening 114 which needs to fully communicate with inlet compartment 122. The illustrated curved bowing of the vertical separator further enables air vent openings 118 also to communicate with the inlet compartment, as best seen in FIGS. 23 and 25. It is to be understood, however, that the vertical separator need not be curved as illustrated; it may take any configuration that will effect its purpose, that is, to provide equally volumed compartments and to oblige the communications of openings 114 with the inlet compartment. Therefore, for example, if the air vent openings were not used as a means to cooperate with a cartridge inserting and removing tool, as above described, and/or entry opening 114 were not centrally positioned in top wall 110, or for any other reason apart from its compartment volume-defining purpose, vertical separator 120 may be otherwise configured.

Figure 16:
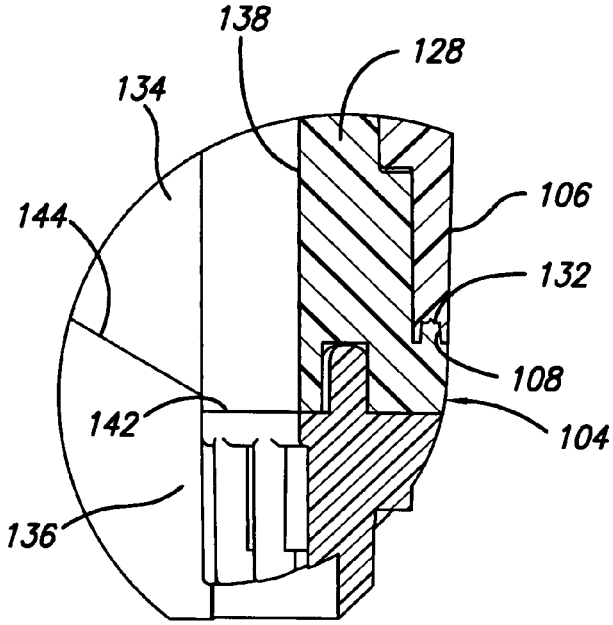
FIG. 16 is a cross-sectional enlarged view of the cartridge taken along cutaway line 16 of FIG. 7.
Figure 17:
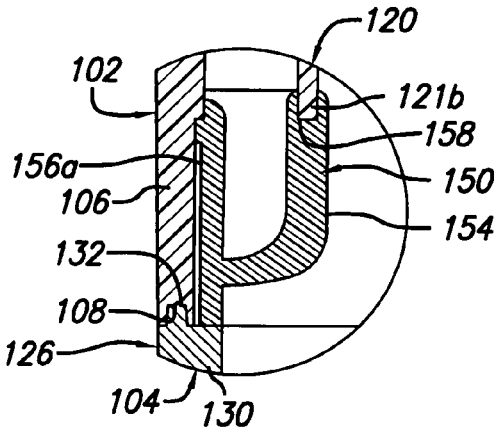
FIG. 17 a cross-sectional enlarged view of the cartridge taken along cutaway line 17 of FIG. 9.
Figure 18:
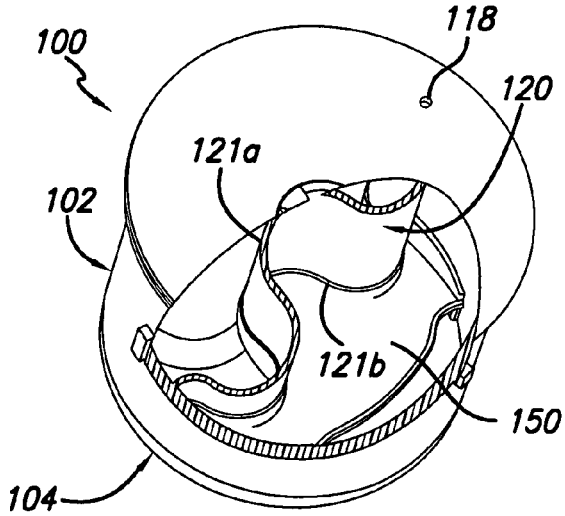
FIG. 18 is a perspective enlarged view of the cartridge taken from its top side with a portion cutaway to expose its inner structure.

Bottom portion 104, as depicted in FIGS. 11-15, comprises a pan 126 and discharge section 128 extending upwardly therefrom. The upper surface of pan 126 defines a bottom wall 127 of cartridge 100; bottom wall 127 may be likened as being the mate to top wall 110. The pan includes a side wall 130 terminating at an edge 132 (FIGS. 14 and 15) which provides a tongue-in-groove engagement with tubular wall 106 at its lower end opening 108, as best seen in FIGS. 16 and 17 to provide a fluid-tight engagement between top and bottom portions 102 and 104. The inner surfaces of pan 126 are rounded to prevent sharp-angled corners and are smoothed to enhance fluid flow and to discourage build up of matter and bacteria or other debris.

Figure 11:
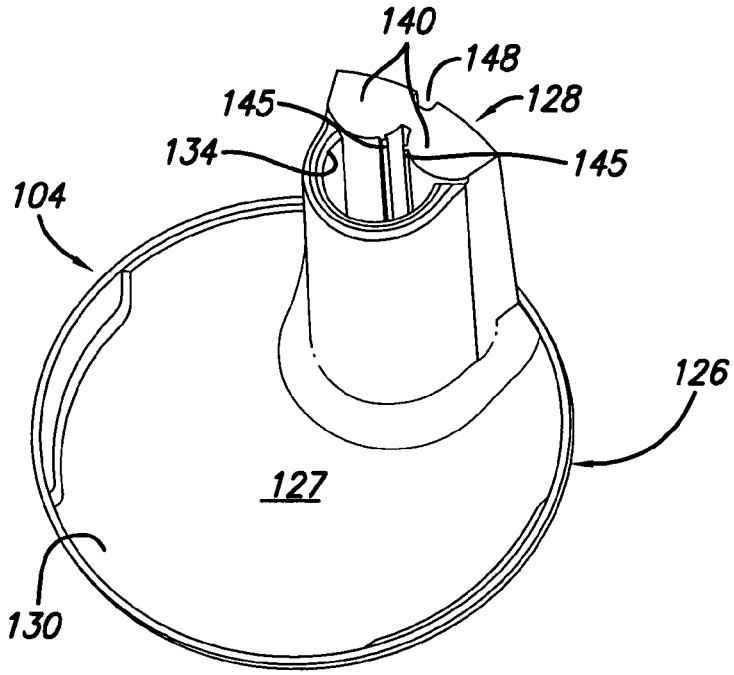
FIGS. 11 and 12 are perspective views of the bottom portion of the cartridge viewed respectively from its top and bottom.
Figure 12:
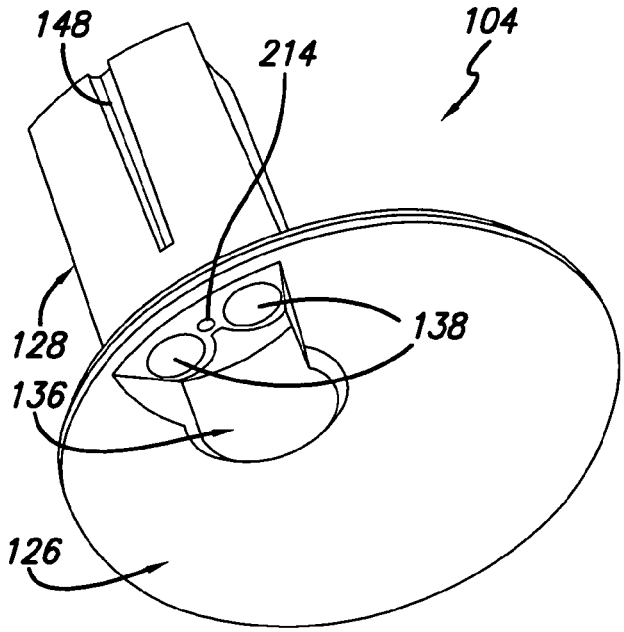
Figure 13:
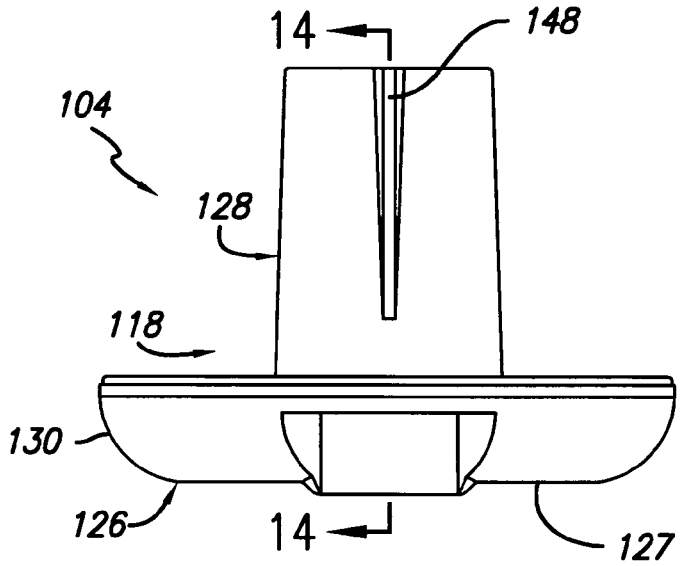
FIG. 13 is a side view of the cartridge bottom portion.
Figure 14:
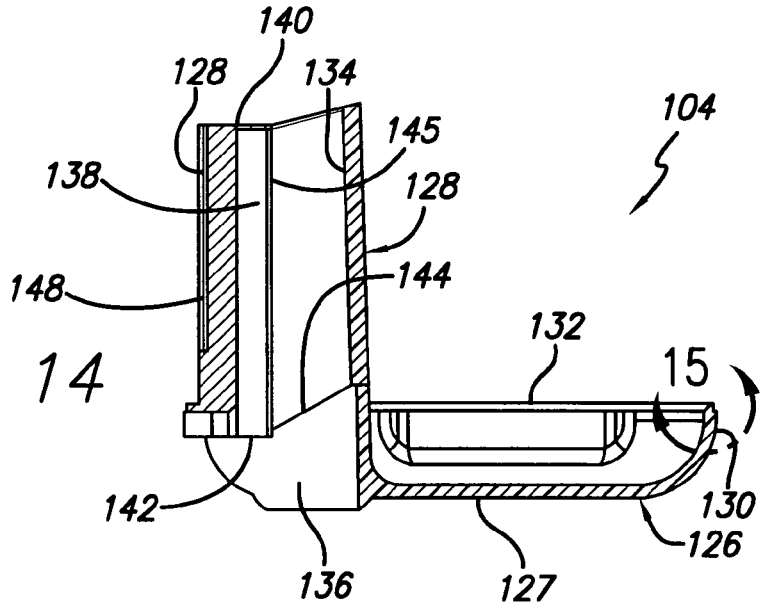
FIG. 14 is a cross-sectional view of the bottom portion taken along line 14-14 of FIG. 13.
Figure 15:
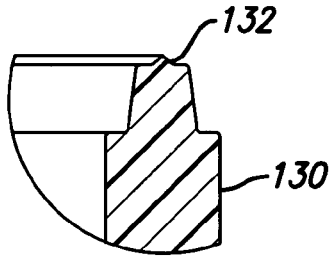
FIG. 15 is a cross-sectional enlarged view of the cartridge top portion taken along cutaway line 15 of FIG. 14.
Figure 19:
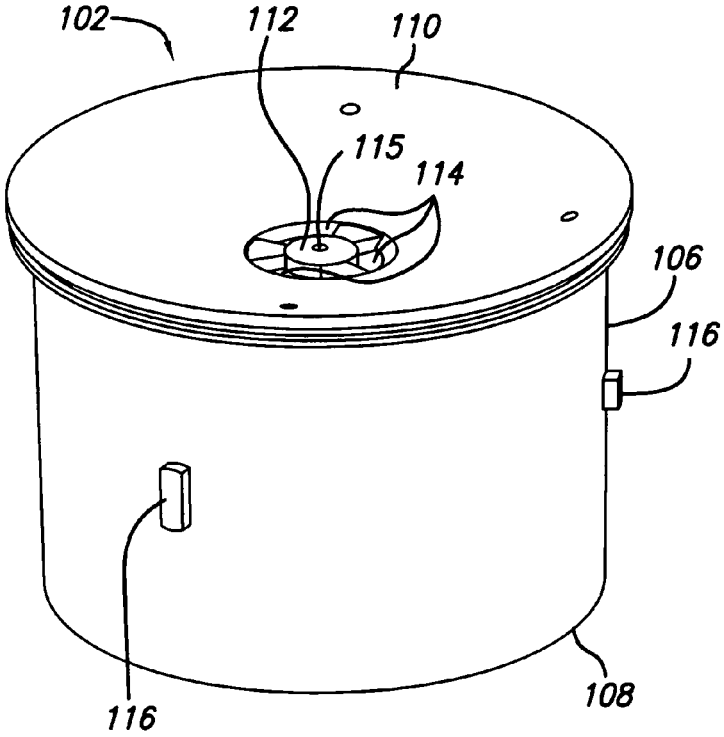
FIGS. 19 and 20 are perspective views of the top portion of the cartridge taken respectively from its top and bottom.
Figure 20:
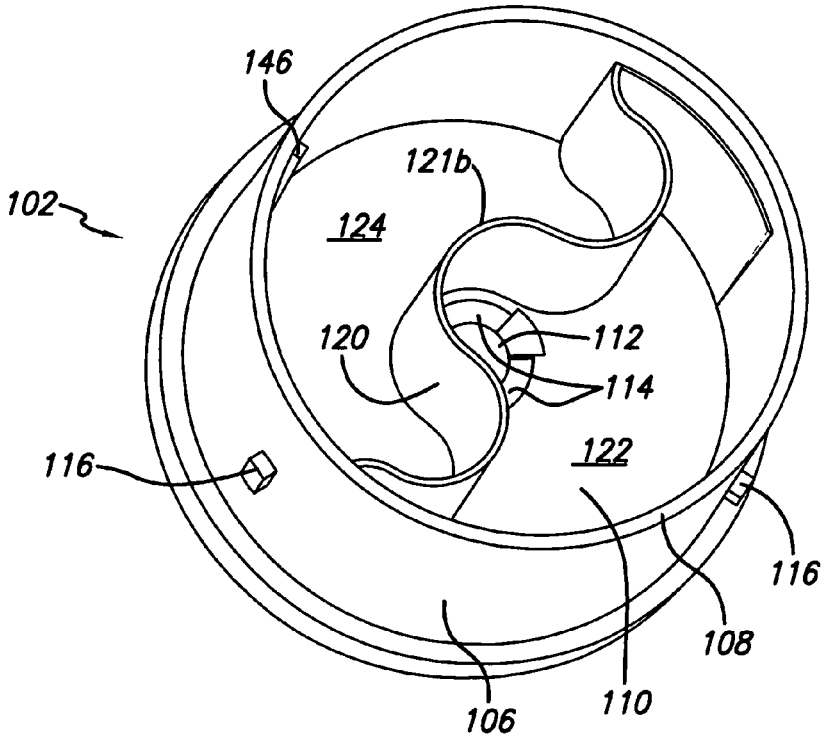
Figure 21:
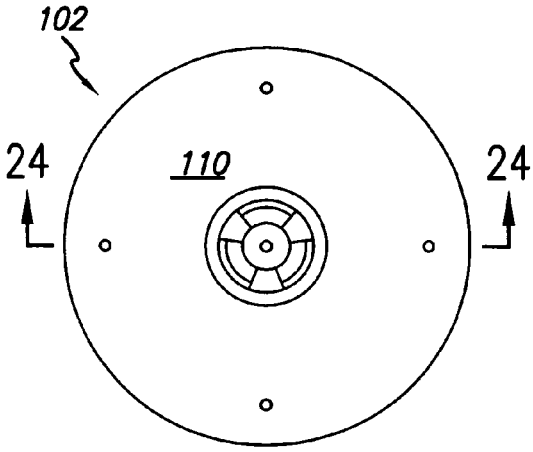
FIGS. 21-23 respectively are top, side and bottom views of the cartridge top portion.
Figure 22:
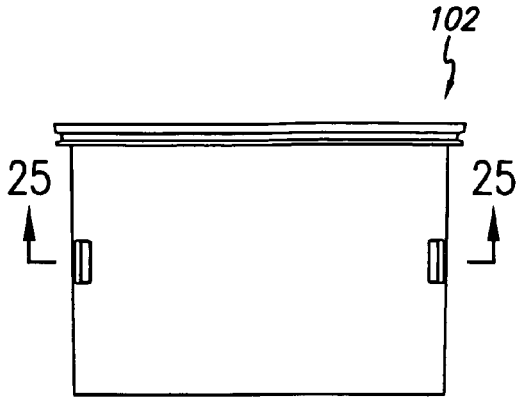

Upwardly extending discharge section 128, which as described above extends into outlet compartment 124 of top portion 102, includes a tube 134 (as best seen in FIGS. 11 and 14) that communicates with outlet compartment 104 and opens at an exit port area 136 (FIGS. 2, 12 and 14) through pan 126 for discharge of fluids, e.g., fluid 103, and other undesired matter from the outlet compartment to a drain 220 (FIG. 44). The discharge section also includes a pair of tubular chambers 138 (e.g., FIGS. 8, 12, 14 and 44) for receipt of post-treatment chemicals for treating the exiting urine, as contained in control stick 224 or pellets, as more fully described in copending application Ser. No. 11/032,508 (provisional application No. 60/579,921). Chambers 138 are closed at wall 140 (see FIGS. 11 and 14) at one of their ends at the uppermost part of upwardly extending discharge section 128 to prevent flow of fluids thereinto from the outlet compartment, and are open at their other ends 142 (see FIG. 14).

As shown in FIGS. 7, 14, 16 and 44, a flow director 144 in tube 134 adjacent exit port area 136 comprises an angled part which is adapted to direct fluid flow towards ends 142 of tubular chambers 138 for impacting control stick 224, as presently described. A pair of longitudinally extending ribs 145 (see FIGS. 11 and 14) are formed in and extend along the length of conduit 134 and terminate adjacent to tubular chamber ends 142 and act further as flow directors also to direct fluid flow towards ends 142.

As shown in FIGS. 7, 14, 16 and 44, a key 146 and a keyway 148 are provided respectively on the interior surface of tubular wall 106 (see FIGS. 8, 20, 23, 25 and 26) and on the backside of upwardly extending discharge section 128 (see FIGS. 8 and 11-14). The key and keyway are disposed to provide an orientation and proper alignment between top and bottom portions 102 and 104 and, through the orienting mechanism of keys 116 with the urinal, to place exit port area 136 adjacent exterior drain 220 from cartridge 100.

Figure 10:
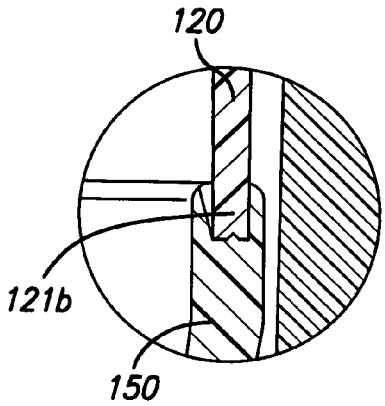
FIG. 10 is a cross-sectional enlarged view of the cartridge taken along cutaway line 10 of FIG. 7.

As depicted in FIGS. 2, 7-10, 12, 17 and 18 and, more in detail in FIGS. 28-35, a baffle 150 is disposed to be secured to curved vertical separator 120 (FIGS. 2, 7 and 10) and acts as a mechanism for improved direction and flow of wastewater fluids through the cartridge in a region from inlet compartment 122 to outlet compartment 124. The baffle comprises a curved base 152 from which a center wall 154 and side walls 156*a* and 156*b* upwardly extend. Wall 154, which terminates in a groove 158 at its upper edge, has the same curvature as that of curved vertical separator 120 so that groove 158 will mate with and fit securely within vertical separator end 121*b*, such as illustrated in FIGS. 10 and 17. Walls 156*a* and 156*b* are curved similarly as or otherwise contoured in conformance with the inner wall of tubular wall 106, and the top and bottom walls may be accordingly shaped differently from that as shown and as dictated by wall 106. Further, the dimension of baffle 150 between walls 156*a* and 156*b* is sized to form a snug, fluid-tight fit of the baffle within tubular wall 106, also as shown in FIGS. 8 and 17. Therefore, fluids within inlet compartment 122 are forced to flow onto the surface of curved base 152.

Figure 30:
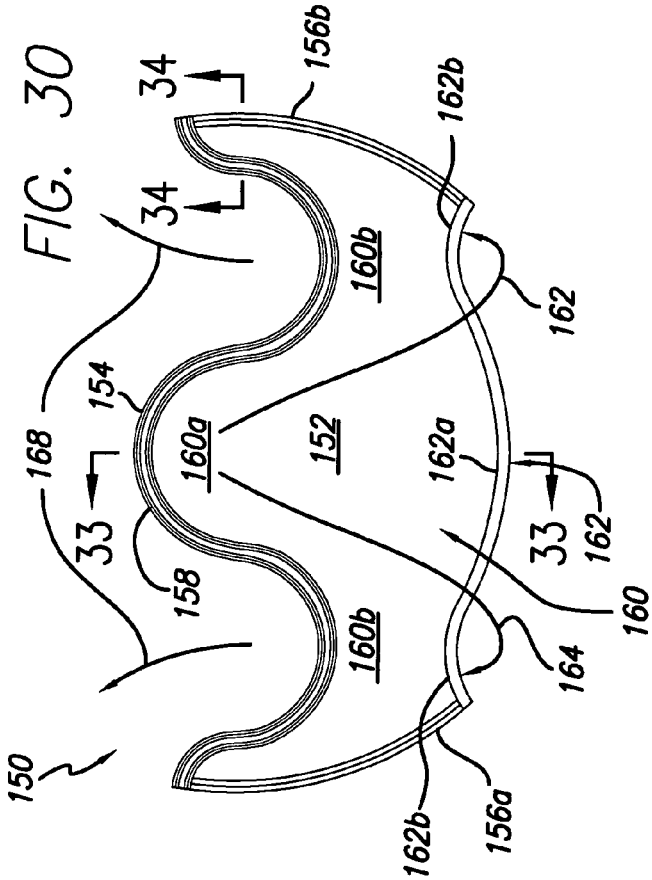
Figure 31:
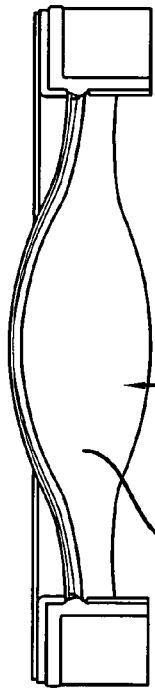

With respect to the curvature of base 152, which acts as a weir, the base is carefully configured to effect several desired results to provide an undulated, non-planar or like configuration of baffle 150. The curved base has a lowermost segment 160, which is slightly lower at its center part or point 160*a* than at its adjacent side parts or points 160*b*. Base 152 curves generally at 90 from generally upstanding wall 154, and all parts 160*a* and 160*b* rise to an undulated termination or terminal edge 162. Termination 162 has a center part 162*a* which is slightly elevated from its neighboring side parts 162*b*. This curved configuration of the baffle directs fluid 103 (e.g., as shown in FIGS. 7 and 9) to flow in the directions generally portrayed by arrow-headed lines 164, that is, from center part 160*a* to side parts 162*b* and thence under the baffle, between its underside 166 and the upper surface of bottom portion pan 126. The fluids then exit into outlet compartment 124 as portrayed generally by arrow-headed lines 168, as depicted in FIG. 30. The directed flow paths, as represented by arrow-headed lines 164 and 168 provide a constriction that increases the flow velocity and avoids the resistance of flow due to deposits on bottom portion 104 generally within the region from inlet compartment 122 to outlet compartment 124. The increased velocity thus effects channels of least resistance through any solid matter deposited in the region between the inlet and outlet compartment and at least minimizes any deposit of such solid matter. The above-described components or parts of baffle 150 may therefore be defined as channeling media.

Figure 36:
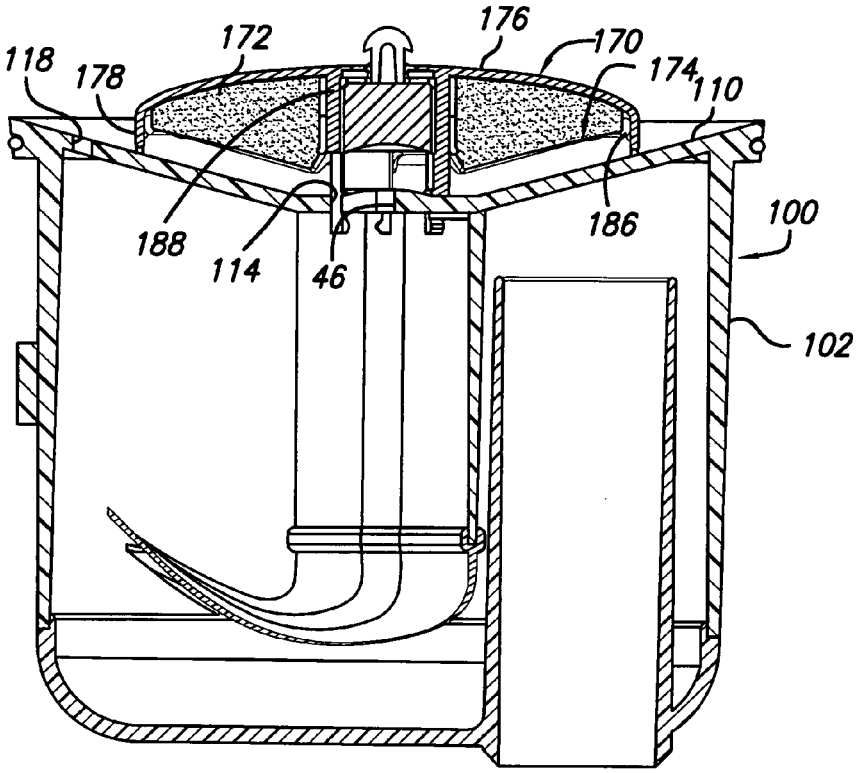
FIG. 36 is a cross-sectional view of a cartridge, such as depicted in FIG. 1 et seq., with a first embodiment of a urine diverter secured to its top wall.
Figure 37:
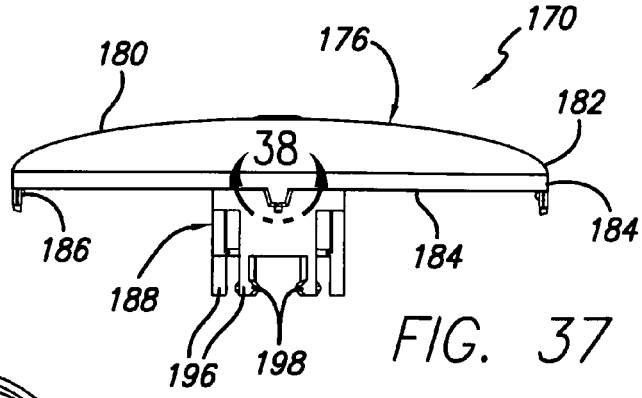
FIG. 37 is a side view of the diverter illustrated in FIG. 36.
Figure 38:
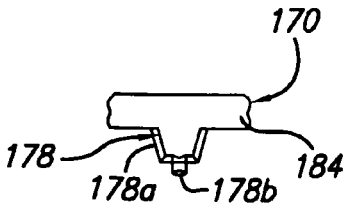
FIG. 38 is an enlarged view of a spacing standoff taken along cutaway line 38 of FIG. 37.

Reference is now made to FIGS. 36-43, and to a urine diverter whose two illustrative embodiments are shown as diverters 170 and 270. For the first embodiment shown in FIGS. 36-39, a pretreatment control tablet 172 is held within a tablet retainer mechanism 174 for holding the tablet within the diverter. Diverter 170, as generally depicted in FIG. 36, is positionable atop wall 110 of top portion 102 for protectively covering entry opening 114 (e.g., see also FIG. 5) and for providing a circuitous path for flow of urine to the opening. Therefore, urine is prevented from directly contacting and entering into opening 114 and impinging upon sealant 105 within the cartridge. Diverter 170, which includes a shell 176, is slightly spaced from top portion top wall 110 to assure a clear path for flow of the urine and to space retainer 174 and tablet 172 from the top wall. Such spacing is effected by use of standoffs 178 (as best shown in FIG. 38), which depend from shell 176 and comprises a large portion 178*a* and a smaller portion 178*b*. Portion 178*b* is made to be as small as possible to permit the smallest contact of the diverter with the top wall and, therefore, to provide the largest possible unobstructed flow path.

Figure 39:
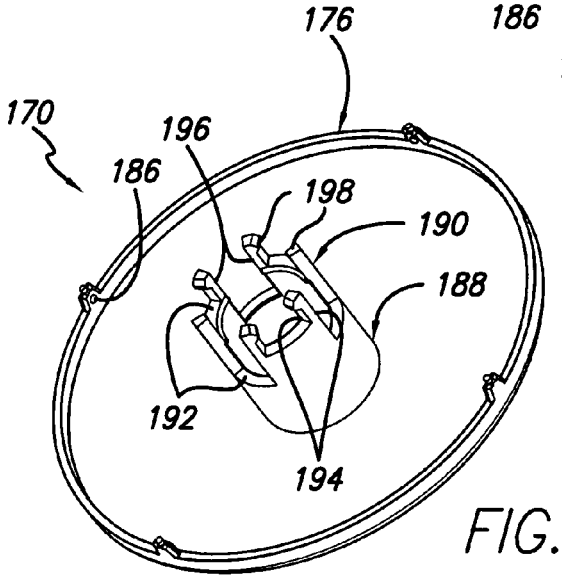
FIG. 39 is a perspective view of the diverter shown in FIG. 36 viewing its underside.

As depicted also in FIGS. 37 and 39, shell 176 comprises an upper surface 180, terminated by a periphery 182 with a downwardly depending flange 184. Upper surface 180 slopes downwardly towards periphery 182 to encourage flow of urine towards the periphery. Inwardly-facing bumps 186 are formed on large portion 178*a* of standoffs 178 for holding tablet retainer 174 to the inside of shell 176.

A tubular housing 188 preferably of cylindrical configuration is secured at one end to the center of the under surface of shell 176 and terminates in a latching mechanism 190 at its second end 192 which has a bi-level shape. The second end is also formed with cutaway portions 194, as configured by the shape of bi-level end 192, into legs 196 to permit a bending of the latching mechanism. Latching mechanism 190 comprises pairs of facing teeth 198 at the ends of legs 196 which are adapted to latch into arced slots 114*a*, 114*b* and 114*c* of top wall 110 for securing diverter 170 to top portion 102.

Tablet retainer 174 is more fully disclosed in provisional application No. 60/535,463 and its non-provisional application Ser. No. 11/032,508, filed on 9 Jan. 2005 whose contents are incorporated herein as if set forth in haec verba.

A pair of post-treatment discharge control sticks 224 or pellets are disposed to be placed within tubular chambers 138 and may include a biocide and cleaning agents held in a time-release binder. Its use is primarily as a descaling agent to help maintain a clean drain pipe, and especially in environments where the cartridge use pattern is such that additional descaling is needed. The post-treatment discharge control sticks or pellets may be used alone or in conjunction with pretreatment control tablet 172. Like tablet retainer 174, the post-treatment discharge control stick or pellets is more fully disclosed in provisional application No. 60/535,463 and its non-provisional application Ser. No. 11/032,508, filed on 9 Jan. 2005 whose contents are incorporated herein as if set forth in haec verba.

Figure 41:
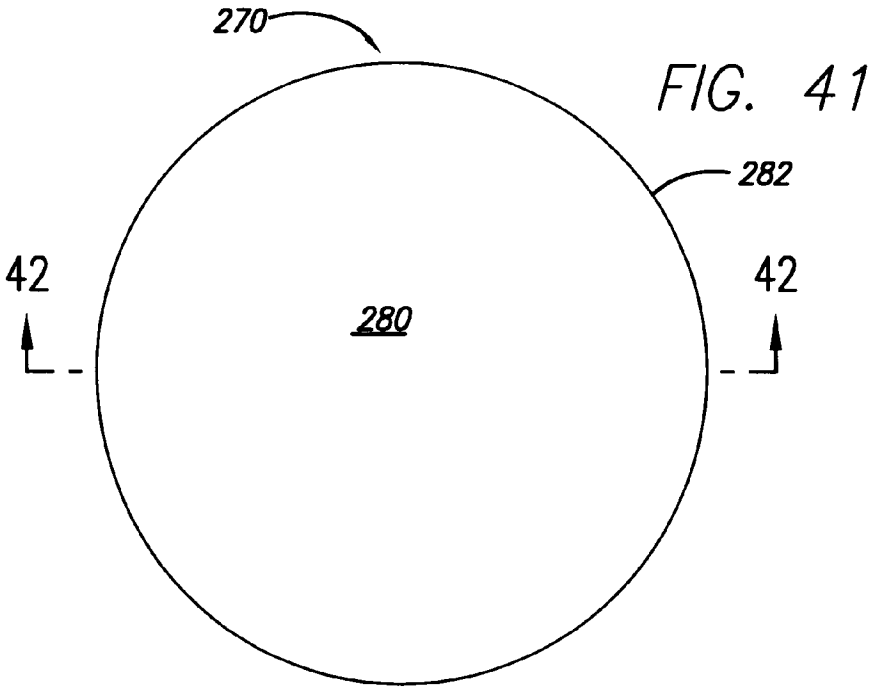
FIG. 41 is a top view of the diverter shown in FIG. 40.
Figure 42:
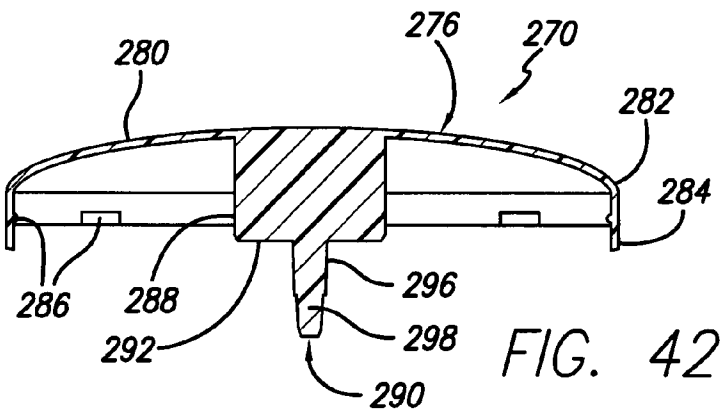
FIG. 42 is a cross-sectional view of the diverter taken along line 42-42 of FIG. 41.
Figure 43:
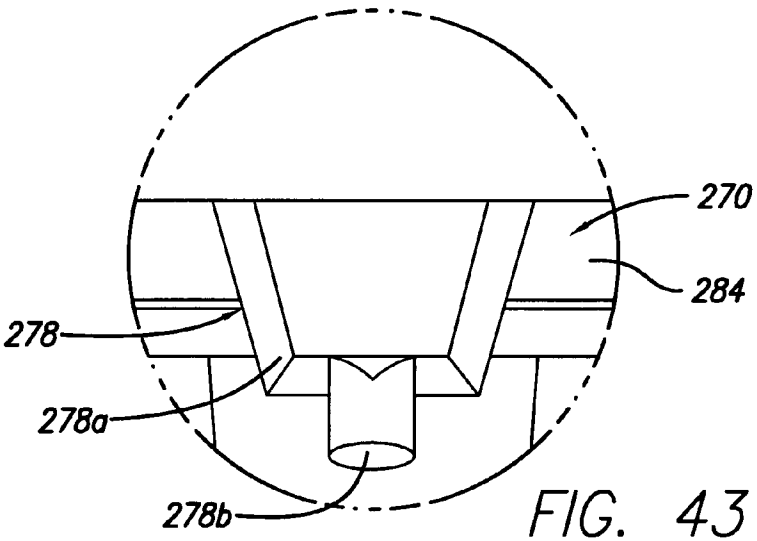
FIG. 43 is an enlarged view of a spacing standoff taken along cutaway line 43 of FIG. 40.

The second embodiment of the diverter, diverter 270, is shown in FIGS. 40-43. This diverter is positionable atop wall 110 of top portion 102 and protectively covers entry opening 114 (e.g., see also FIG. 5) in a manner similar to that shown for diverter 170 in FIG. 36, and provides a circuitous path for flow of urine to the opening. Therefore, urine is prevented from directly contacting and entering into opening 114 and impinging upon and agitating sealant 105 within the cartridge. In addition, a pretreatment control tablet may be held within a tablet retainer for holding the tablet within the diverter, again as described above. Diverter 270, which includes a shell 276, is slightly spaced from top portion top wall 110 to assure a clear path for flow of the urine and to space the retainer and its retained tablet from the top wall. Such spacing is effected by use of standoffs 278 (as best shown in FIG. 43), which depend from shell 276 and comprises a large portion 278*a* and a smaller portion 278*b*. Portion 278*b* is made to be as small as possible to permit the smallest contact of the diverter with the top wall and, therefore, to provide the largest possible unobstructed flow path.

Figure 40:
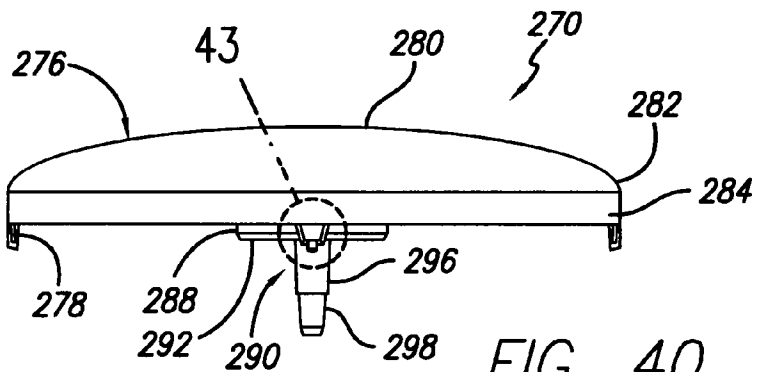
FIG. 40 is a side view of a second embodiment of a diverter which is useful as an alternate to that depicted in FIG. 36.

As depicted also in FIGS. 40-42, shell 276 comprises an upper surface 280, terminated by a periphery 282 with a downwardly depending flange 284. Upper surface 280 slopes downwardly towards periphery 282 to encourage flow of urine towards the periphery. Inwardly-facing bumps 286, which are more elongated than previously described bumps 186, are formed on large portion 278*a* of standoffs 278, as well as on other inner parts of flange 284, for holding the tablet retainer, such as previously described retainer 174, to the inside of shell 276.

A base 288, preferably of cylindrical configuration, is secured at one end to the center of the under surface of shell 276 and terminates in a fastener 290 at its second end 292. The fastener is formed as a post 296 terminating in a beveled end 298. Fastener 290 is sized to form an interference fit within hole 115 of top wall 110 for securing diverter 270 to top portion 102.

Figure 1:
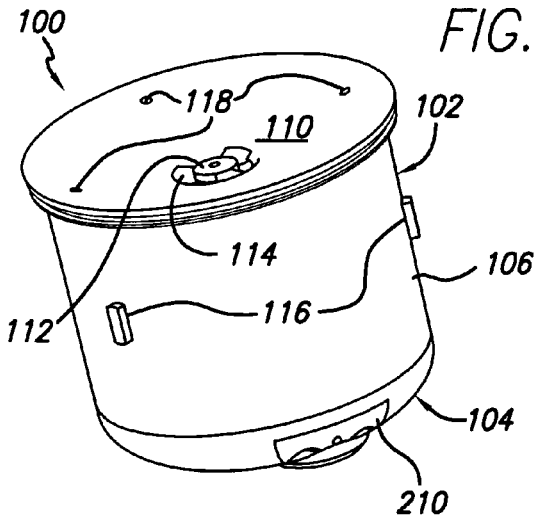
FIG. 1 is a perspective view of a flow trap cartridge usable in a water-free urinal.
Figure 2:
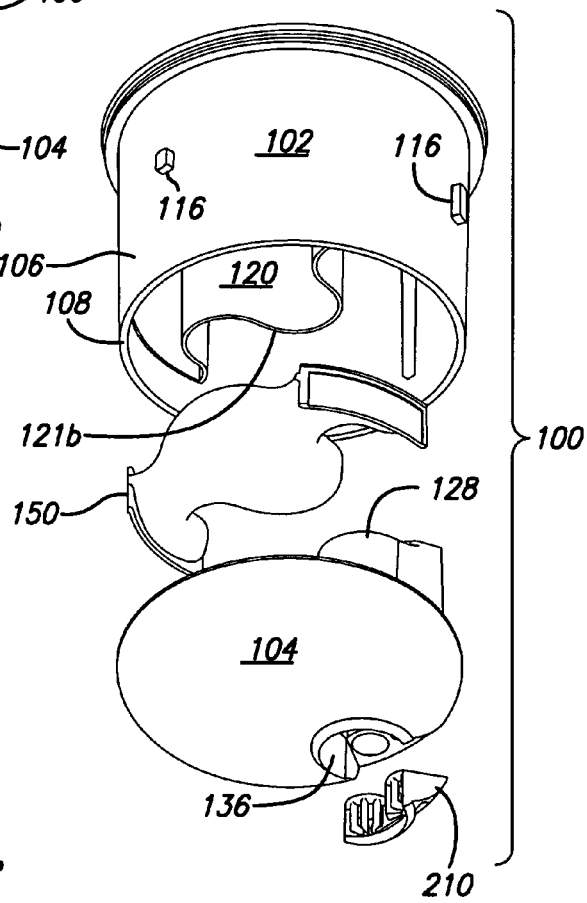
FIG. 2 is an exploded view, in perspective, of the cartridge shown in FIG. 1.
Figure 3:
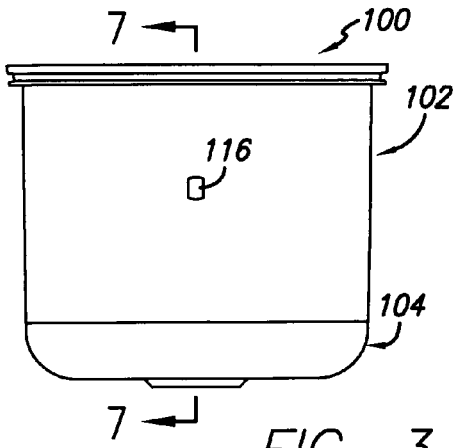
FIGS. 3-6 are, respectively, two side views taken 180° from one another, a top view and a bottom view of the cartridge.
Figure 4:
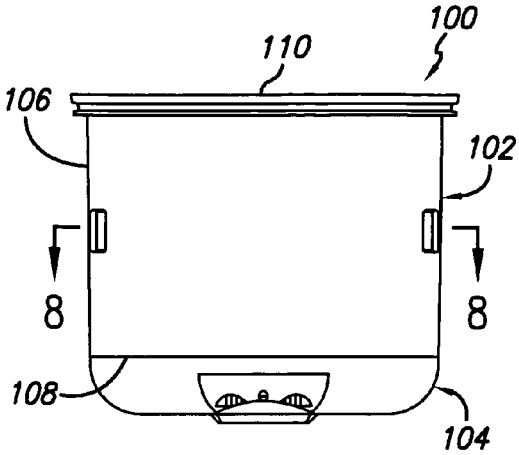

When all the above-described components are assembled together, they form cartridge 100 as depicted, for example, in FIGS. 1 and 36. This assembled cartridge is then adapted to be placed within a urinal 226 (FIG. 44) which, in turn, is coupled to drain 220 with exit port area 136 as provided through the orienting mechanism of keys 116. An O-ring seal 228 is sealingly placed within recess 117 in the periphery of top wall 110.

While separator 120, baffle 150 and other components are described as providing a preferred cooperative arrangement, it is to be understood that these individual components may be employed separately should the user so choose.

Accordingly, although the invention has been described with respect to particular embodiments thereof, it should be realized that various changes and modifications may be made therein without departing from the spirit and scope of the invention.

What is claimed is:

1. A urine cartridge comprising:

an inlet compartment for receipt of urine;

an outlet compartment for transfer of the urine from said inlet compartment to an external drain;

fluid contained within said compartments;

a sealant floatable above the fluid contained within said inlet compartment; and a separator separating said compartments into substantially equal volumes for enabling the pressures in said compartments to be substantially equal, the substantially of the equal volumes between said two compartments being effective to militate against syphoning of the sealant from said inlet compartment to said outlet compartment and, thereby, to militate against premature failure and a reduction in the usable life of said cartridge; and a baffle between said inlet and outlet compartments having an undulated configuration including lower and upper points directing the wastewater towards said outlet compartment.

2. A urine cartridge according to claim 1 in which said separator comprises an arcuately-shaped wall.

3. A urine cartridge according to claim 1 further including top and bottom walls in which said top wall has an opening therein and is disposed to receive and to permit the urine to pass into said inlet compartment, and wherein said separator comprises a bowed wall which has a fluid-tight fitting to said top wall sufficient to prevent direct communication of the fluid between said opening and said outlet compartment and which is spaced from said bottom wall to permit communication of the fluid between said inlet and outlet compartments.

4. A urine cartridge according to claim 1 in which said baffle effects a channel of least resistance through any solid matter deposited between said inlet and outlet compartments.

5. A urine cartridge according to claim 1 further comprising:

a top wall in which said top wall has an opening therein and is disposed to receive and to permit the urine to pass into said inlet compartment; and a diverter for avoiding direct access of the urine to the opening;

a shell placeable on the upper wall of the cartridge and over the opening therein; and a spacer spacing said shell from the top wall to permit urine to flow into the top wall opening of the cartridge.

6. A diverter according to claim 5 in which said shell includes an essentially fluid-obstructing upper surface bounded by a periphery which is spaced from the upper wall of the cartridge by said spacer, whereby said essentially fluid-obstructing upper surface is configured to direct the urine towards said periphery and thence onto the cartridge upper wall for entry into the upper wall opening.

7. A diverter according to claim 6 in which said shell includes a latching mechanism engageable with said cartridge upper wall opening for securing said diverter to the cartridge.

8. A urine cartridge comprising:

an inlet compartment for receipt of urine;

an outlet compartment for transfer of the urine from said inlet compartment to an external drain;

fluid contained within said compartments; and a mechanism between said inlet and outlet compartments effecting a channeling media of least resistance through any solid matter deposited therebetween, said mechanism including a non-planar configuration which increases the flow velocity of the fluid and avoids the resistance of flow due to any deposits on a portion generally within the region from said inlet compartment to said outlet compartment, so that the increased velocity thus effects channels of least resistance through any solid matter deposited in the region between the inlet and outlet compartment.

9. A urine cartridge according to claim 8 further comprising:

a top wall in which said top wall has an opening therein and is disposed to receive and to permit the urine to pass into said inlet compartment; and a diverter for avoiding direct access of the urine to the opening;

a shell placeable on the upper wall of the cartridge and over the opening therein; and a spacer spacing said shell from the top wall to permit urine to flow into the top wall opening of the cartridge.

10. A diverter according to claim 9 in which said shell includes an essentially fluid-obstructing upper surface bounded by a periphery which is spaced from the upper wall of the cartridge by said spacer, whereby said essentially fluid-obstructing upper surface is configured to direct the urine towards said periphery and thence onto the cartridge upper wall for entry into the upper wall opening.

11. A diverter according to claim 10 in which said shell includes a latching mechanism engageable with said cartridge upper wall opening for securing said diverter to the cartridge.

12. A cartridge for handling wastewater comprising:

an inlet compartment for receipt of wastewater;

an outlet compartment coupled to an external drain;

a path coupling said inlet and outlet compartments for transfer of the wastewater from said inlet compartment to the external drain; and a mechanism between said inlet and outlet compartments having undulating media directing the wastewater in multiple paths of varying velocity within said coupling path towards said outlet compartment and effecting at least one channel of least resistance between said inlet and outlet compartments.

13. In a cartridge having an inlet compartment for receipt of fluids including urine and an outlet compartment for transfer of the fluids from the inlet compartment to an external drain through a path normally coupling the inlet and outlet compartments, a method for improving the life of the urine cartridge comprising the step of:

inducing channeling paths of differing flow velocities within the normally coupling path and through any solid matter deposited in a region between the inlet and outlet compartments.

14. The method according to claim 13 in which said inducing step comprises the step of at least vigorously flowing the fluids through the region.

15. The method according to claim 14 in which said vigorously flowing step comprises the step of effecting a constriction in the region that increases the flow velocity of the fluid therethrough.

16. The method according to claim 15 in which said constriction effecting step comprises the step of constricting the fluid flow path.

17. The method according to claim 13 further comprising the step of providing substantially equal volumes in the inlet and outlet compartments for enabling the pressures between the compartments to be substantially equal.

18. The method according to claim 13 further comprising the step of substantially equalizing the pressures between the compartments.

19. The method according to claim 14 wherein said pressure equalizing step comprises the step of providing substantially equal volumes in the compartments.

20. In a cartridge having an inlet compartment for receipt of fluids including urine and a sealant floatable on the fluid in the inlet compartment, and an outlet compartment for transfer of the fluids from the inlet compartment to an external drain, a method for improving the life of the urine cartridge comprising the steps of:

substantially equalizing the pressures between the compartments for effectively militating against any syphoning of the sealant from the inlet compartment to the outlet compartment and, thereby, to militate against premature failure and a reduction in the usable life of the cartridge; and utilizing non-planar channeling media between the inlet and outlet compartments to effect channels through any solid matter deposited in a region between the inlet and outlet compartments.

21. The method according to claim 20 wherein said pressure equalizing step comprises the step of providing essentially equal volumes in the compartments.

22. The method according to claim 20 in which said channeling step comprises the step of vigorously flowing the fluids through the region.

23. The method according to claim 22 in which said vigorously flowing step comprises the step of effecting a constriction by use of the non-planar channeling media in the region that increases the flow velocity of the fluid therethrough.

24. The method according to claim 23 in which said constriction effecting step comprises the step of constricting the fluid flow path.

25. A wastewater trap having an inlet compartment for receipt of fluids including urine, a sealant floatable on the fluid in the inlet compartment, an outlet compartment for transfer of the fluids from the inlet compartment to an external drain, and a separator separating said inlet and outlet compartments and having an S-shaped wall.

26. A wastewater trap comprising:

an inlet compartment for receipt of wastewater;

an outlet compartment for transfer of the wastewater from said inlet compartment to an external drain;

fluid contained within said compartments;

a sealant floatable above the fluid contained within said inlet compartment; and a separator separating said compartments; and an S-shaped baffle between said inlet and outlet compartments.

27. A wastewater trap comprising:

an inlet compartment for receipt of wastewater;

an outlet compartment for transfer of the wastewater from said inlet compartment to an external drain;

fluid contained within said compartments;

a layer of sealant floatable above the fluid contained within said inlet compartment; and an S-shaped separator separating said compartments into substantially equal volumes.

28. A urine cartridge comprising:

an inlet compartment for receipt of urine;

an outlet compartment for transfer of the urine from said inlet compartment to an external drain;

fluid contained within said compartments; and a sealant floatable above the fluid contained within said inlet compartment;

a separator separating said compartments into substantially equal volumes for enabling the pressures in said compartments to be substantially equal, the substantially of the equal volumes between said two compartments being effective to militate against syphoning of the sealant from said inlet compartment to said outlet compartment and, thereby, to militate against premature failure and a reduction in the usable life of said cartridge; and non-planar channeling media between the inlet and outlet compartments to effect channels through any solid matter deposited in a region between the inlet and outlet compartments.

* * * * *